US005816431A

United States Patent [19]

Giannopoulos

[11] Patent Number: 5,816,431

[45] Date of Patent: Oct. 6, 1998

[54] WASTE CONTAINER LINER-SECURING DEVICE

[76] Inventor: Linda L. Giannopoulos, 37 Francis St., Uniontown, Pa. 15401

[21] Appl. No.: 807,145

[22] Filed: Feb. 27, 1997

[51] Int. Cl.[6] ..... B65D 7/12

[52] U.S. Cl. ..... 220/495.11; 220/495.06; 220/908.3

[58] Field of Search ..... 220/404, 495.06, 220/495.11, 908.1, 908.3

[56] References Cited

U.S. PATENT DOCUMENTS

| | | | |
|---|---|---|---|
| 3,130,853 | 4/1964 | Colthurst et al. | 220/17 |
| 3,779,419 | 12/1973 | Heitz | 220/63 R |
| 4,444,355 | 4/1984 | Cary | 220/404 |
| 4,630,752 | 12/1986 | De Mars | 220/404 |
| 4,753,367 | 6/1988 | Miller et al. | 220/404 |
| 4,765,579 | 8/1988 | Robbins, III et al. | 220/404 |
| 4,805,789 | 2/1989 | Robbins, III et al. | 220/404 |
| 4,834,260 | 5/1989 | Auten | 220/404 |
| 4,892,224 | 1/1990 | Graham | 220/404 |
| 5,478,152 | 12/1995 | Bogle | 383/33 |

*Primary Examiner*—Joseph M. Moy
*Attorney, Agent, or Firm*—Webb Ziesenheim Bruening Logsdon Orkin & Hanson, P.C.

[57] ABSTRACT

A wastebasket useable with a flexible receptacle liner includes an insert. The insert includes a collar and a plurality of legs extending from the collar. When the insert is positioned inside the wastebasket, the ends of the legs opposite the collar are position between the closed lower end of the wastebasket and the upper rim of the wastebasket and the collar of the insert is positioned adjacent the upper rim of the wastebasket. The collar of the insert and the side wall of the wastebasket form a gap therebetween for accepting the open end of a flexible waste container liner.

20 Claims, 6 Drawing Sheets

34
80'
84'
82'
86'
88'
92'
90'
4

34
86'
96'
88'
82'
90'
4

34
86'
88'
94'
82'
90'
4

34
106'
108'
100'
102'
104'

34
102'
104'
110'
108'

34
108'
102'
104'
110'

WASTE CONTAINER LINER-SECURING DEVICE

BACKGROUND OF THE INVENTION

1. Field of the Invention

The present invention relates to the art of wastebaskets, or waste containers, and more specifically, to supports for flexible open ended bags positioned in wastebaskets.

2. Description of the Prior Art

It is common practice to position a flexible open ended wastebasket liner with the open end of the liner draped over the upper rim of the wastebasket. When hung in this manner, the open end of the liner covers the upper rim of the wastebasket and the upper part of the outside wall of the wastebasket.

It is desirable to utilize such liners with wastebaskets in a manner that does not cover the upper rim or the outside wall of the wastebaskets.

It is therefore an object of the present invention to provide a waste container liner securing device which maintains the open end of a flexible wastebasket liner open while hiding the open end of the liner inside a wastebasket. It is an object of the present invention to provide wastebasket liner securing device that is shippable with the wastebasket without becoming separated therefrom. Still, further advantages of the present invention will become apparent to those of ordinary skill in the art upon reading and understanding the following detailed description of the preferred embodiments.

SUMMARY OF THE INVENTION

In accordance with one aspect of the invention, a wastebasket includes a container having a side wall extending between an upper rim defining an open end and a closed lower end of the container. A plurality of legs are positioned inside the container. Each leg has a first end secured to the inside of the side wall between the open end of the container and the closed end of the container. The legs extend upwards from the side wall towards the open end of the container and terminate at the second end adjacent the upper rim of the container. A collar is positioned inside the container and is secured to the second end of each leg adjacent the upper rim of the container. The side wall of the container and the collar form a gap therebetween.

The wastebasket includes securing means, such as Velcro®, disposed between the first end of the legs and the inside of the side wall for removably securing the first end of the legs to the inside of the side wall. Alternatively, the securing means includes a headed lug disposed adjacent the first end of each leg and a slotted bracket disposed on the inside of the side wall. The headed lug and slot are designed to cooperate to secure the first end of the leg to the side wall. In another alternative, the securing means includes a headed lug disposed on the inside of the side wall and a slot formed adjacent the first end of the leg.

In another aspect of the invention, an apparatus is provided for securing a waste container liner to a wastebasket having a side wall tapering outwardly from a closed lower end of the wastebasket to an upper rim of the wastebasket defining an open end of the wastebasket. The apparatus includes a ring having a plurality of legs attached thereto and extending in a direction of a central axis of the ring. The apparatus includes means for establishing the ends of the legs opposite the ring to the inside of the side wall between the open end of the wastebasket and the closed lower end of the wastebasket. Establishing the legs to the inside of the side wall positions the ring inside the wastebasket and in spaced relation to the inside of the side wall adjacent the upper rim of the ring in a manner whereby the ring and the side wall form a gap therebetween.

The ring is invertible so that the top of the ring is positionable adjacent the closed lower end of the wastebasket so that the legs extend towards the open end of the wastebasket. A second wastebasket of similar construction is receivable in the open end of the wastebasket when the inverted ring is positioned therein. When the second wastebasket is introduced into the wastebasket, the ring with upwardly extending legs is sandwiched between the inside of the wastebasket and the outside of the second wastebasket.

In another aspect of the invention, a tube is provided for securing a collapsible open end bag to a wastebasket. The tube has a side wall extending between an upper edge and a lower edge of the tube. The tube is positionable inside the wastebasket so that the lower edge is located between a closed end of the wastebasket and an open end of the wastebasket and the upper edge of the tube is positioned adjacent the open end of the wastebasket. The tube and the side wall of the wastebasket form a gap therebetween at least adjacent the upper edge of the wastebasket.

DETAILED DESCRIPTION OF THE PREFERRED EMBODIMENT

Figure 1:
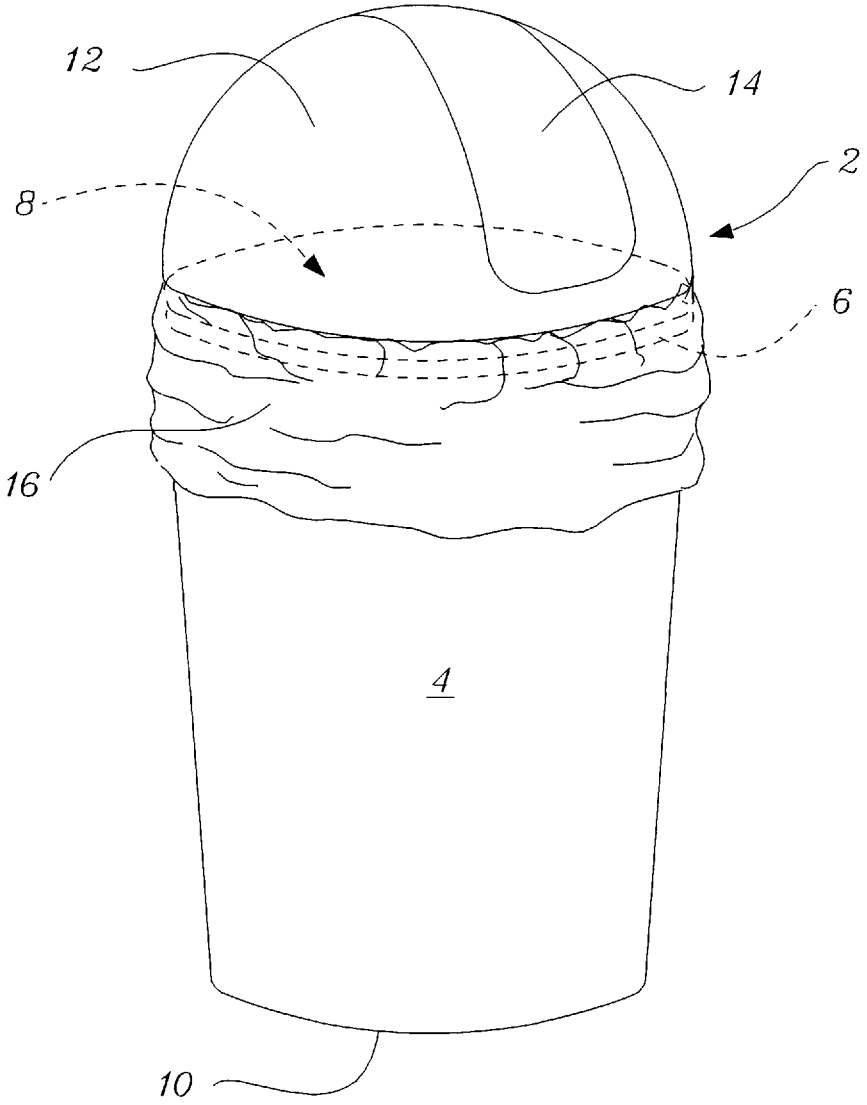
Fig.1. Prior Art
FIG. 1 is a perspective view of a prior art wastebasket having a cover with a pivotable lid thereon.

With reference to FIG. 1, a prior art wastebasket or waste container 2 has a side wall 4, an upper rim 6 (shown in phantom) defining an open upper end 8 (shown in phantom), a closed lower end 10 and a cover 12 with a pivotable lid 14. The side wall 4 tapers outwardly, or diverges, from the closed lower end 10 to the upper end 8. The wastebasket 2 is designed to accept, without limitation, a flexible liner 16 in the form of a collapsible open ended bag. In use, the closed end of the liner 16 is positioned adjacent the closed lower end 10 of the wastebasket 2. The walls of the liner 16 extend upwards and terminate at an open end of the liner 16 which is positioned adjacent the open end 8 of the wastebasket 2. The open end of the liner 16 is opened radially and folded over the upper rim 6 of the wastebasket 2 so the wall of the liner 16 adjacent the open end of the liner 16 covers the rim 6 and the upper part of the outside of the side wall 4 of the wastebasket 2, in the manner illustrated in FIG. 1.

Figure 2:
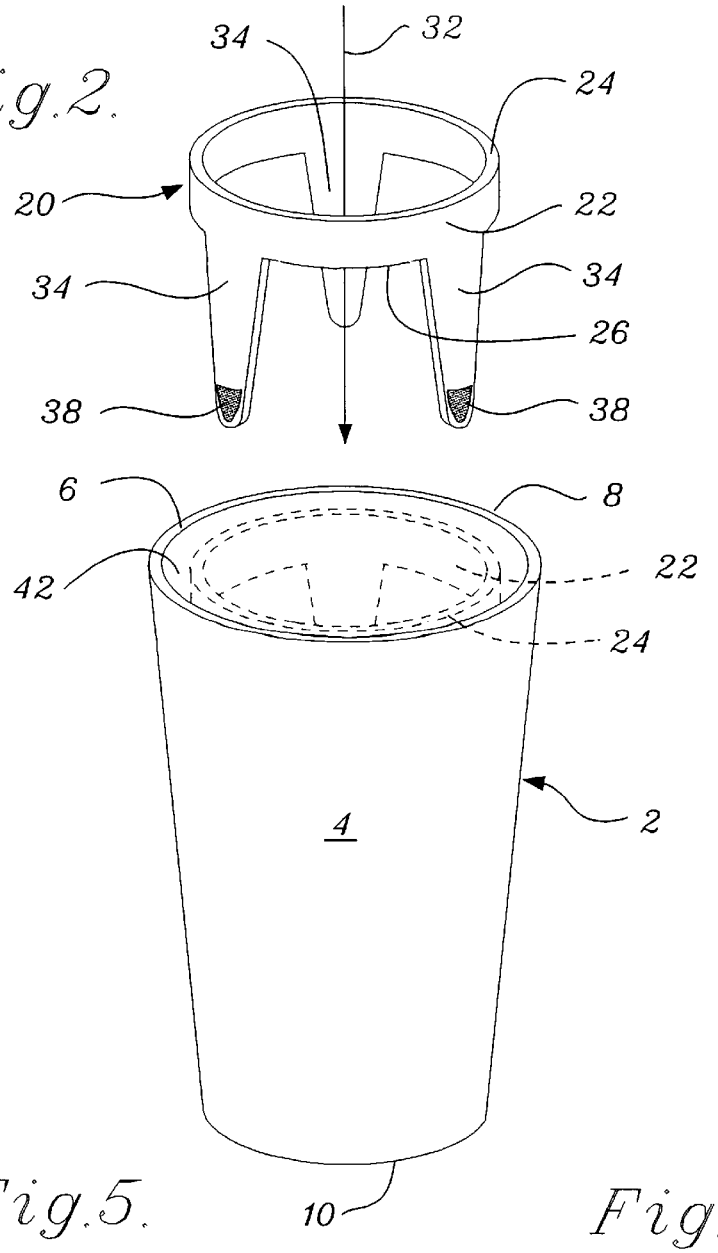
FIG. 2 is an exploded perspective view of a wastebasket and a three-legged insert.
Figure 3:
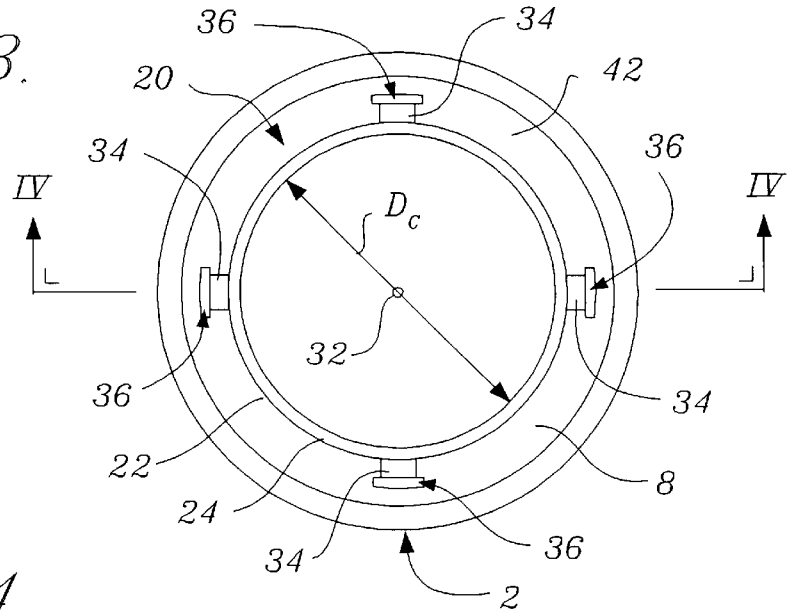
FIG. 3 is a top view of a wastebasket having a four-legged insert positioned therein.
Figure 4:
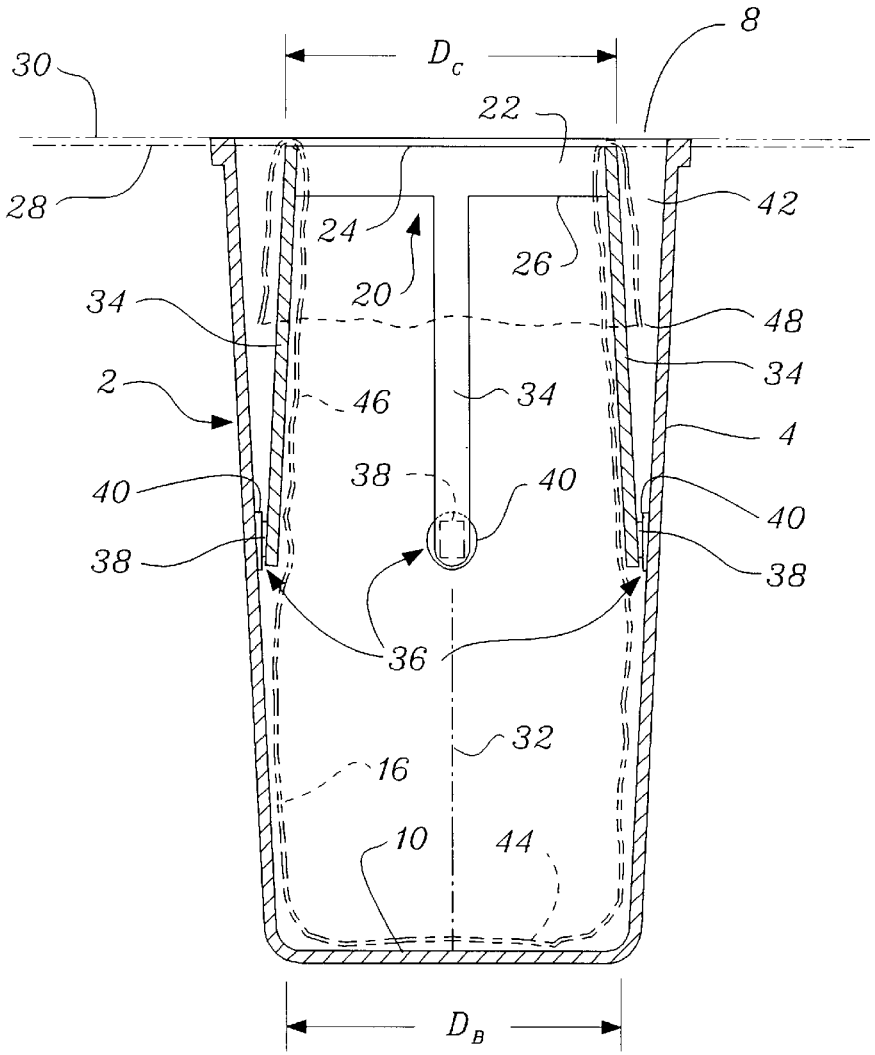
FIG. 4 is a side-sectioned elevational view of the wastebasket and insert of FIG. 3.

With reference to FIGS. 2–4, the wastebasket 2 is provided with an insert 20 inside the wastebasket 2. The insert 20 has a collar or ring 22 that is positioned adjacent the open end 8 of the wastebasket 2 when the insert 20 is installed in the wastebasket 2, as shown in phantom in FIG. 2. The collar 22 defines an upper edge 24 and a lower edge 26. Preferably, the upper edge 24 of the collar 22 has an outline the same shape as the outline of the upper rim 6 of the wastebasket 2. As best seen in FIG. 4, the upper edge 24 of the collar 22 defines a plane 28 that is substantially parallel to a plane 30 defined by the upper rim 6 of wastebasket 2 when the insert 20 is installed in the wastebasket 2. The collar 22 has a central axis 32 that is substantially perpendicular to the plane 28 defined by the upper edge 24 of the collar 22 and coaxial with a central axis 32 of the wastebasket 2.

The insert 20 has a plurality of legs 34 that extend from the lower edge 26 of the collar 22. The ends of legs 34 opposite the collar 22 and the inside of the side wall 4 of the wastebasket 2 are secured together with a securing means 36. In one embodiment, the securing means 36 includes Velcro® strips 38 positioned on the ends of the legs 34 opposite the collar 22 which coact with mating Velcro® strips 40 positioned at select locations inside of the side wall 4 of the wastebasket 2, as best seen in FIG. 4. The legs 34 of the insert 20 are preferably firm in a direction parallel with the central axis 32 to vertically support the collar 22, and flexible in a direction perpendicular to the central axis 32 of the collar 22 to provide for positioning of the insert 20 in a desired manner inside the wastebasket 2.

When the insert 20 is installed inside the wastebasket 2, collar 22 is positioned in spaced relation with the side wall 4 of the wastebasket 2 adjacent the upper rim 6. Preferably, the upper edge 24 of the collar 22 is positioned even with the upper rim 6 of the waste container 2. The legs 34 of the insert 20 extend between the lower edge 26 of the collar 22 and the select locations inside the wastebasket 2 which are positioned between the closed lower end 10 of the wastebasket 2 and the upper rim 6 of the wastebasket 2. The Velcro® strips 38 on the ends of legs 34 opposite the collar 22 coact with the mating Velcro® strips 40 positioned at the plurality of locations inside the wastebasket 2 in a manner to maintain the position of the collar 22 adjacent the open end 8 of the wastebasket 2. When positioned in this manner, the collar 22 and the side wall 4 of the wastebasket 2 form a gap 42 therebetween.

In use, the closed bottom 44 of liner 16, shown in phantom in FIG. 4, is positioned adjacent the closed lower end 10 of the wastebasket 2. A flexible wall 46 of liner 16 is projected upward from the closed bottom 44 of the liner 16 through the inside of the collar 22 of the insert 20 and terminates at an upper edge 48 of the liner 16. The upper edge 48 of the liner 16 is opened radially and folded back into the gap 42 formed between collar 22 and the side wall 4 adjacent the upper rim 6 of the wastebasket 2 in the manner illustrated in phantom in FIG. 4. When installed in this manner, the rim 6 and the outside of the side wall 4 of the wastebasket 2 remain uncovered and the liner 16 is held open to accept waste.

Figure 5:
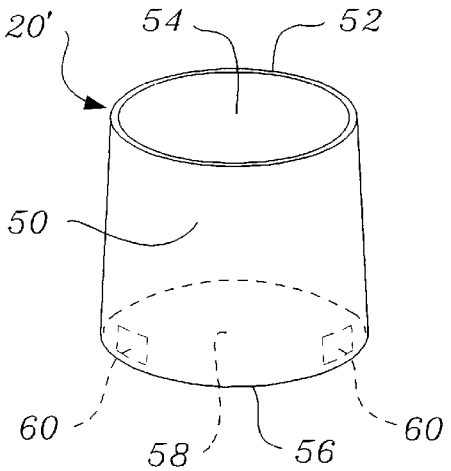
FIG. 5 is a perspective view of a tubular wastebasket insert.

With reference to FIG. 5 and with continuing reference to FIGS. 2–4, an insert 20' is provided in the form of a rigid tube. The insert 20' has a side wall 50 that terminates at an upper edge 52 which defines a first open end 54 and terminates at a lower edge 56 which defines a second open end 58. The insert 20' preferably has an outward taper from the upper edge 52 to the lower edge 56. The insert 20' is installable inside the wastebasket 2 in a manner whereby the upper edge 52 of insert 20' is positioned adjacent the upper rim 6 of the wastebasket 2 and the lower edge 56 of insert 20' is positioned between the closed lower end 10 of the wastebasket 2 and the upper rim 6.

When installed in the wastebasket 2 in this manner, the side wall 50 adjacent the lower edge 56 of insert 20' frictionally engages the outwardly tapering side wall 4 of the wastebasket 2. Frictional interaction between the side wall 4 of the wastebasket 2 and the side wall 50 adjacent the lower edge 56 of the insert 20' seats insert 20' inside the wastebasket 2 in a manner so that side wall 50 adjacent the upper edge 52 of the insert 20' is positioned in spaced relation with side wall 4 adjacent the upper rim 6 of the wastebasket 2. When installed in wastebasket 2, the outward taper of insert 20' is in opposition to the outward taper of the wastebasket 2. These opposing outward tapers cooperate to form a gap, e.g., gap 42 in FIG. 3, between side wall 50 adjacent the upper edge 52 of the insert 20' and side wall 4 adjacent the upper rim 6 of the wastebasket 2.

Alternatively, the side wall 50 adjacent the lower edge 56 of the insert 20' can have Velcro® strips 60 positioned thereon (shown in phantom in FIG. 5) for mating engagement with the Velcro® strips 40 positioned at select locations on the inside of the side wall 4 of the wastebasket 2.

Alternatively, the inside of the side wall 4 of the wastebasket 2 has a medial rim [not shown] formed between the open end 8 and the closed lower end 10 of the wastebasket 2 and designed to engage the lower edge 56 of the insert 20'. The medial rim of the wastebasket 2 is formed on side wall 4 in a manner whereby installing the insert 20' positions side wall 50 adjacent the upper edge 52 of the insert 20' in spaced relation with side wall 4 adjacent the upper rim 6 of wastebasket 2.

Figure 6:
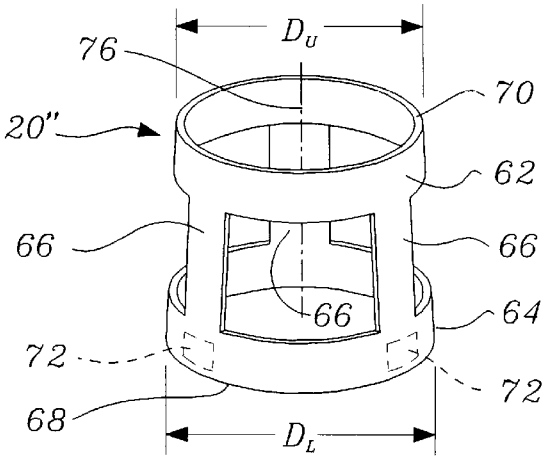
FIG. 6 is a perspective view of a wastebasket insert having an upper collar, a lower collar and a plurality of legs extending therebetween.

With reference to FIG. 6 and with continuing reference to FIGS. 2–4, an insert 20" includes an upper collar 62, a lower collar 64 and a plurality of legs 66 extending therebetween. The lower collar 64 has a diameter $D_L$ that is larger than a diameter $D_U$ of the upper collar 62. Thus, like the insert 20' of FIG. 5, insert 20" has a generally outwardly taper, i.e., insert 20" diverges, from the upper collar 62 to the lower collar 64. When the insert 20" is installed in the wastebasket 2, the outside wall of the lower collar 64 adjacent a lower edge 68 of the lower collar 64 frictionally engages the inside of the side wall 4 of the wastebasket 2 between the closed lower end 10 and the open end 8 in a manner so that a top edge 70 of the upper collar 62 is positioned adjacent the upper rim 6 of the wastebasket 2. When installed in this manner, the taper of insert 20" is in opposition to the taper of wastebasket 2. These opposing tapers cooperate to form a gap, e.g., gap 42 in FIG. 3, between the upper collar 62 and side wall 4 adjacent upper rim 6 of the wastebasket 2.

Alternatively, the lower collar 64 can have Velcro® strips 72 positioned thereon (shown in phantom in FIG. 6) for engagement with the mating Velcro® strips 40 positioned at select locations on the inside of the side wall 4 of the wastebasket 2. In yet another alternative, the inside of the side wall 4 of the wastebasket 2 has a medial rim (not shown) formed between the open end 8 and closed lower end 10 of the wastebasket 2 for engaging the lower edge 68 of the lower collar 64 in a manner whereby a gap is formed between the upper collar 62 and the side wall 4 adjacent upper rim 6 of wastebasket 2.

Figure 7:
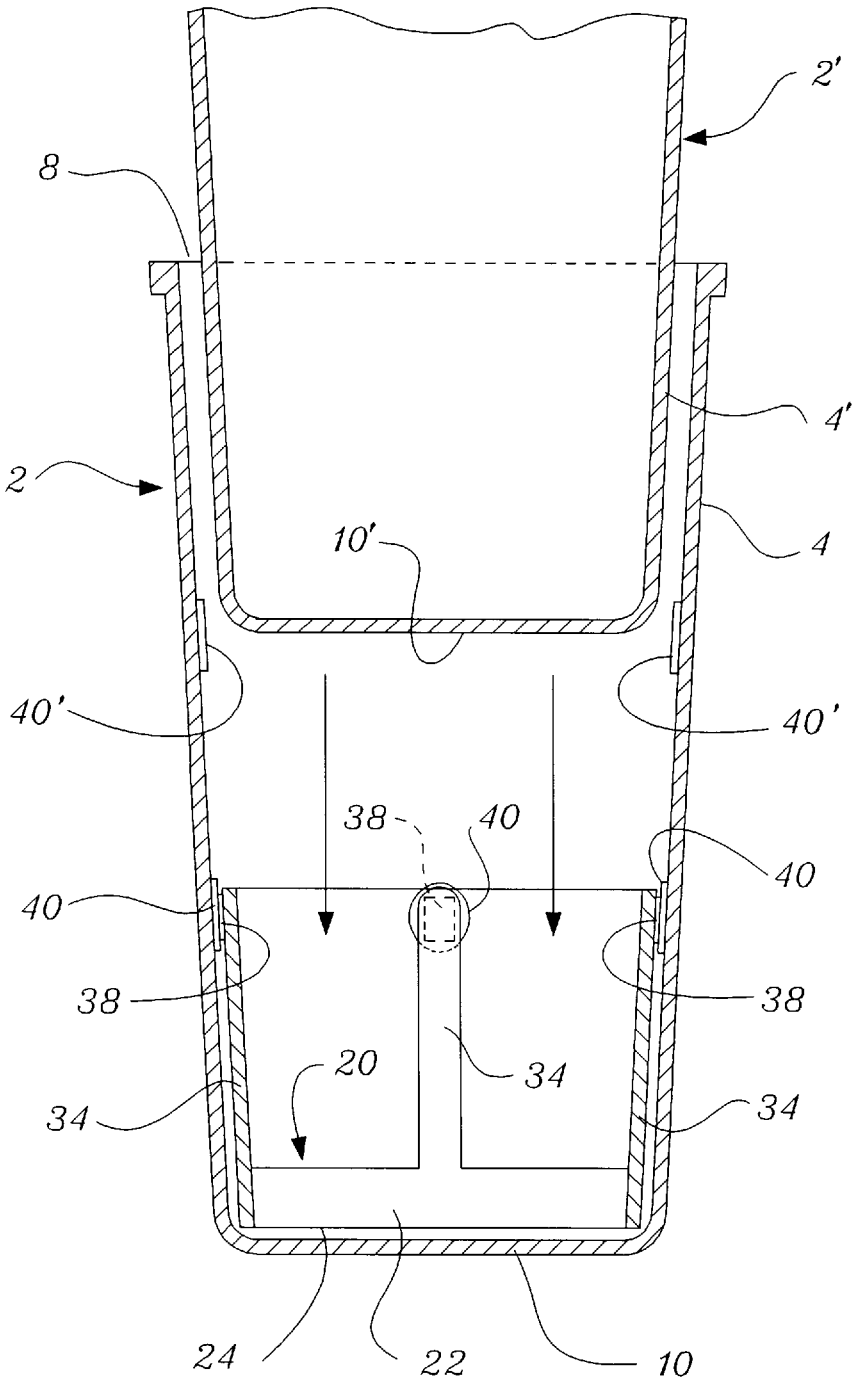
FIG. 7 is a side-sectioned elevational view of an upper wastebasket being positioned in a lower wastebasket, and a four-legged insert positioned on the inside bottom of the lower wastebasket.

With reference to FIG. 7 and with continuing reference to FIG. 4, when shipping stacks of wastebaskets, it is desirable to stack one wastebasket inside another. It is also desirable to have the inserts, e.g., insert 20, shipped with the wastebasket 2 in a manner whereby the inserts and the wastebaskets remain associated during shipping. Hence, collar 22 of the insert 20 is formed with a diameter $D_C$ the same size or smaller than the diameter $D_B$ of the closed lower end 10 of the wastebasket 2, as shown in FIG. 4.

During shipping, the insert 20 is inverted and inserted into the wastebasket 2, as shown in FIG. 7, so that the collar 22 is positioned at the closed lower end 10 of the wastebasket 2 and the legs 34 extend upwardly towards the open end 8 of the wastebasket 2. Another, or second, wastebasket 2' is introduced through the open end 8 of the wastebasket 2. Moving the closed lower end 10' of the second wastebasket 2' closely adjacent closed lower end 10 of wastebasket 2 sandwiches the legs 34 of the insert 20 between side wall 4 of wastebasket 2 and side wall 4' of wastebasket 2'.

To ensure that an insert 20 does not become disassociated from a wastebasket in a stack of wastebaskets, the Velcro® strips 38 positioned on the ends of the legs 34 of the insert 20 opposite the collar 22 are secured to the mating Velcro® strips 40 positioned at the select location on the inside of the side wall 4 of the wastebasket 2. Another plurality of mating Velcro® strips 40' is positioned at select locations inside the side wall 4 above the mating Velcro® strips 40. These Velcro® strips 40' engage the Velcro® strips 38 on the ends of legs 34 when the insert 20 is positioned for use inside the wastebasket 2, as shown for example in FIG. 4. Providing Velcro® strips 40 and Velcro® strips 40' enables the legs 34 to be formed to a desired length while also providing for secure shipment and use of the insert 20 with the wastebasket 2.

The above inserts were described as either frictionally engaging the inside wall of the side wall 4 of the wastebasket 2; secured to the inside wall of the side wall 4 of the wastebasket 2 utilizing Velcro® strips, e.g., 38 and 40; or have a lower edge, e.g., 56 or 68, that engages and coacts with a medial rim or edge (not shown) inside the side wall 4 of the wastebasket 2. Alternatively, however, a headed lug and locking slot combination can be utilized to secure the insert 20 to the side wall 4 of the wastebasket 2.

Figure 8C:
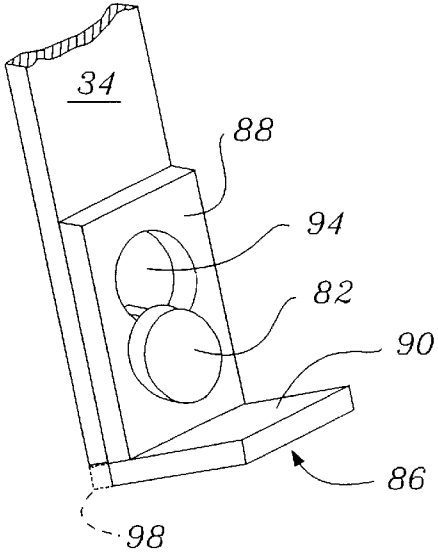
FIGS. 8A–8C are perspective views of a headed lug and slot arrangement for removably securing the legs of the insert to the inside of the side wall of the wastebasket.
Figure 8B:
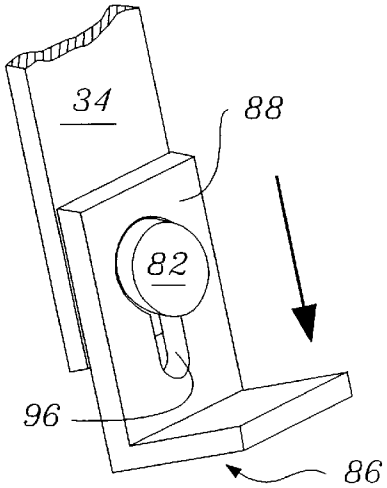
Figure 8A:
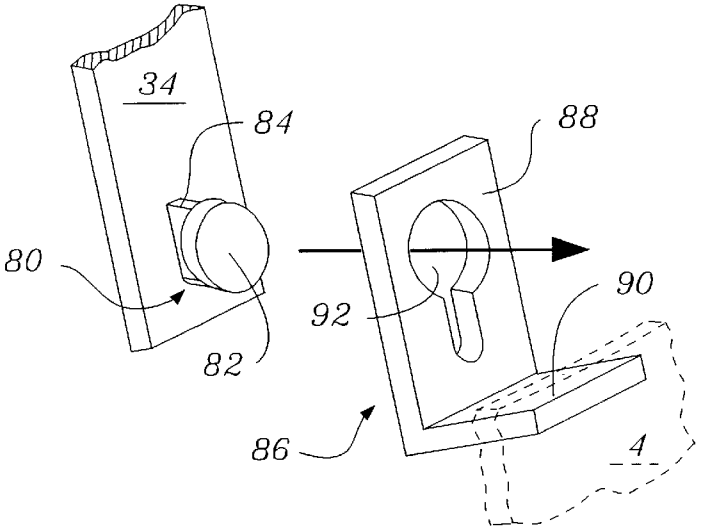

With reference to FIGS. 8A–8C and with continuing reference to FIGS. 2–4, an outwardly projecting headed lug 80 is positioned adjacent the end of the leg 34 opposite the collar 22. The distal end, or head end, of the headed lug 80 has a disk-shaped member 82. A vertically oriented rib 84 extends between the leg 34 and the disk-shaped member 82 and secures the disk-shaped member 82 to the end of the leg 34 opposite the collar 22. An L-shaped bracket 86 is positioned on the inside of the side wall 4, a portion of which is shown in phantom in FIG. 8A, between the open end 8 and the closed lower end 10 of the wastebasket 2. The L-shaped bracket 86 has a vertical side 88 and a leg 90 extending between the lower end of the vertical side 88 and the side wall 4 of the wastebasket 2. The leg 90 secures the vertical side 88 in spaced relation with the side wall 4 of the wastebasket 2.

The vertical side 88 has a vertically oriented locking slot 92 formed therein. The locking slot 92 has a rounded upper end 94 and a channel shaped lower end 96. The rounded upper end 94 is of sufficient size to accept the disk-shaped member 82 therethrough.

In use, the end of the leg 34 opposite the collar 22 is moved in alignment with the face of vertical side 88 opposite side wall 4 so that the disk-shaped member 82 projects through the rounded upper end 94 of the locking slot 92 and the rib 84 is positioned above the channel shaped lower end 96 of the locking slot 92. When the leg 34 is moved downward, as illustrated in FIG. 8B, the rib 84 is captured between the vertical walls of the channel shaped lower end 96 of the locking slot 92 and the disk-shaped member 82 is captured between the vertical member 88 and the side wall 4 of the wastebasket 2. In this manner, the headed lug 80 and the locking slot 92 cooperate to secure the end of the leg 34 opposite the collar 22 to the L-shaped bracket 86 and consequently the side wall 4.

The leg 90 of the L-shaped bracket 86 can also include a lip 98 that extends from leg 90 in a direction opposite side wall 4 of the wastebasket 2, shown in phantom in FIG. 8C, for engaging the bottom edge of the leg 34 when the headed lug 80 is engaged in the locking slot 92.

Alternatively, the disk-shaped member 82 can be positioned on the opposite side of leg 34 so that the leg 34 is captured between the vertical side 88 and the side wall 4 when the rib 84 is captured between the vertical walls of the channel shaped lower end 96 of the locking slot 92. In this alternative, the disk-shaped member 82 projects to the inside of the wastebasket 2 when the headed lug 80 and the locking slot 92 are engaged.

Figure 9C:
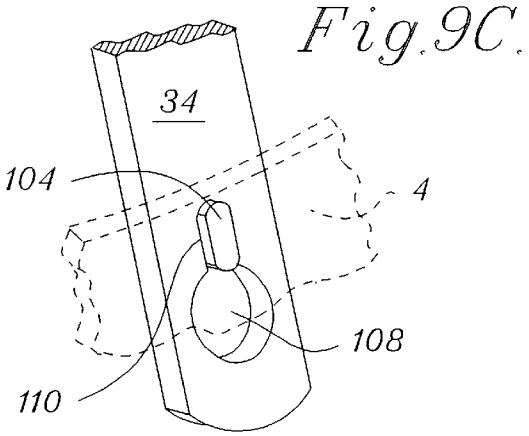
FIGS. 9A–9C are perspective views of one alternate embodiment of the headed lug and slot combination for removably securing the legs of the insert to the inside of the side wall of the wastebasket.
Figure 9B:
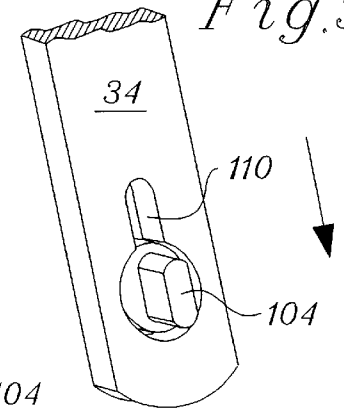
Figure 9A:
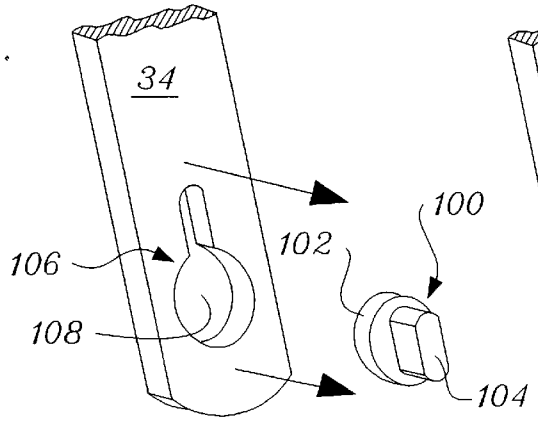

With reference to FIGS. 9A–9C, in yet another alternative, the headed lug and locking slot combination includes a lug 100 secured to the inside of the side wall 4 of the wastebasket 2 and extending inwardly. The lug 100 includes disk-shaped member 102 on the distal end of the lug 100 and vertically oriented rib 104 extending between the disk-shaped member 102 and the inside of the side wall 4, a part of which is shown in phantom in FIG. 9C. The end of the leg 34 has a vertically oriented locking slot 106 therein having circular lower end 108 of sufficient size for receiving the disk-shaped member 102 therethrough, and a channel shaped upper end 110 for receiving the vertically oriented rib 104.

In use, the circular lower end 108 of the locking slot 106 on the end of the leg 34 is positioned so that the disk-shaped member 102 projects therethrough. Once the disk-shaped member 102 is projected through the circular lower end 108 of the locking slot 106, the leg 34 is urged downwardly so that the rib 104 is captured between the sides of channel shaped upper end 110 of the locking slot 106. Further downward movement of leg 34 is prevented by the top of the rib 104 contacting an upper edge of the locking slot 106. In this manner, the leg 34 is secured to the side wall 4 of wastebasket 2.

Figures 10A, 10B, 10C, 11A, 11B, 11C:
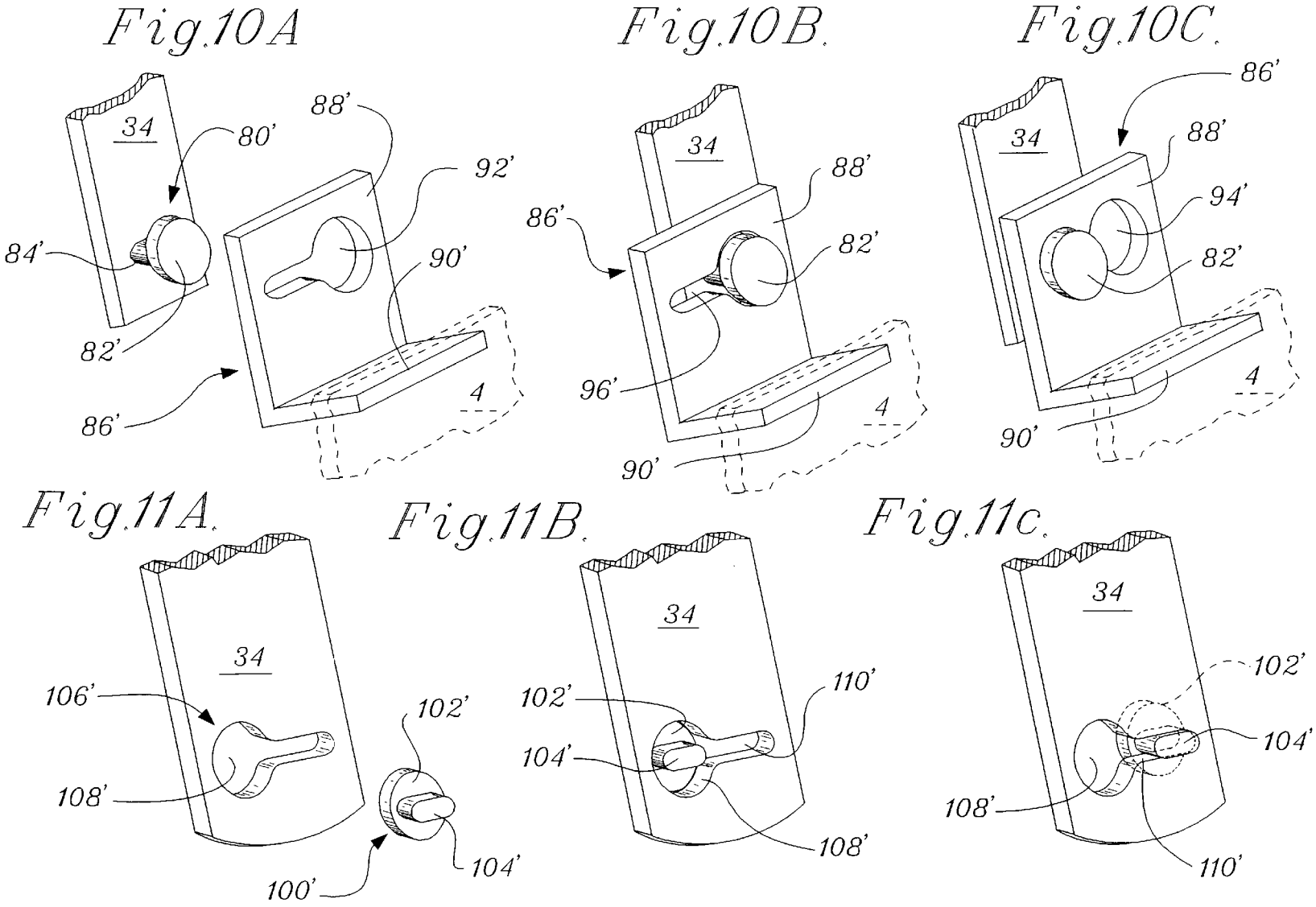
FIGS. 10A–10C are perspective views of another alternate embodiment of the headed lug and slot combination for removably securing the legs to the inside of the side walls of the wastebasket.
FIGS. 11A–11C are perspective views of still another alternate embodiment of the headed lug and slot combination for removably securing the legs to the inside of the side walls of the wastebasket.

With reference to FIGS. 10A–10C, a headed lug 80' is positioned adjacent the end of the leg 34 opposite the collar 22. The distal end of the headed lug 80' has a disk-shaped member 82'. A laterally oriented rib 84' extends between the leg 34 and the disk-shaped member 82'. An L-shaped bracket 86' is positioned on the inside of the side wall 4. The L-shaped bracket has a vertical side 88' and a leg 90' extended between the lower end of the vertical side 88' and the side wall 4 of the wastebasket 2.

The vertical side 88' has a laterally oriented locking slot 92' formed therein. The locking slot 92' is rounded at one end 94' and channel-shaped at an opposite end 96'.

In use, the disk-shaped member 82' is projected through the rounded side 94' of the locking slot 92'. Moving the leg 34 laterally sandwiches the rib 84' between the opposing walls of the channel-shaped side 96' of the locking slot 92'. This movement of the leg captures the disk-shaped member 82' between the vertical member 88' and the side wall 4 of the wastebasket 2.

With reference to FIGS. 11A through 1C, in yet another alternative, a lug 100' is secured to the inside of the side wall 4 of the wastebasket 2 and extending inwardly. The lug 100' includes disk-shaped member 102' on the distal end of the lug 100' and a laterally oriented rib 104' extending between the disk-shaped member 102' and the inside of the side wall 4. The leg 34 includes a laterally oriented locking slot 106' having a circular side 108' on one side thereof and a channel-shaped side 110' on the other end thereof.

In use, the disk-shaped member 102' is projected through the circular side 108' of the locking slot 106'. Moving the leg 34 laterally captures the rib 104' between the sides of the channel-shaped side 110' of the locking slot 106'.

The invention has been described with reference to the preferred embodiment. Obvious modifications and alterations will occur to others upon reading and understanding the preceding detailed description. For example, while described in connection with a removable insert, e.g., insert 20, the wastebasket 2 could also be formed with an integral insert. Moreover, inserts 20' and 20" could also be formed without a taper—the taper of inserts 20' and 20" being utilized to accent the gap between the top of the inserts and the rim 6 of the wastebasket 2. Furthermore, the headed lug and locking slot can be formed in another manner that maintains the lug in the slot. It is intended that the invention be construed as including all such modifications and alterations insofar as they come within the scope of the appended claims or the equivalents thereof.

What is claimed is:

1. A wastebasket useable with a flexible receptacle liner having a flexible wall extending between a closed lower end and an open end thereof, said wastebasket comprising:

a container having a closed lower end and an upwardly extending side wall terminating in an upper rim, said upper rim defining an open end of said container;

a plurality of legs positioned inside the container, each leg having a first end secured to the inside of the side wall between the open end of the container and the closed lower end of the container and a second end extending towards the open end of the container; and a collar positioned inside the container and secured to the second end of each leg adjacent the upper rim of said container, said side wall and said collar forming a gap therebetween of sufficient size for receiving the open end of the flexible wall therein.

2. The wastebasket as set forth in claim 1 further including securing means disposed between the first end of the legs and the inside of the side wall for removably securing the first end of the legs to the inside of the side wall.

3. The wastebasket as set forth in claim 2 wherein the securing means includes Velcro®.

4. The wastebasket as set forth in claim 2 wherein the securing means includes a lug positioned on each leg adjacent the first end thereof and a slotted bracket positioned on the inside of the side wall, said slot extending one of axially and laterally to an axis of the wastebasket and in spaced relation with the side wall thereof, said slot sized to receive the lug therein, said slot closed at one end thereof to limit the travel of the lug in the slot.

5. The wastebasket as set forth in claim 2 wherein the securing means includes a lug positioned on the inside of the side wall and extending into the wastebasket and a slot formed in the leg adjacent the first end thereof and extending one of axially and laterally to the length of the leg, said slot sized to receive the lug therein, said slot closed at one end thereof to limit the travel of the lug in the slot.

6. The wastebasket as set forth in claim 4 wherein the slot is a locking slot and the lug is headed.

7. The wastebasket as set forth in claim 1 wherein said collar and said side wall are substantially coaxial.

8. An apparatus for securing a waste container liner to a first wastebasket having a side wall tapering outwardly from a closed lower end of said first wastebasket to an upper rim defining an open end of said first wastebasket, said apparatus comprising:

a collar;

a plurality of legs attached to one side of said collar and extending in a direction of a central axis of said collar; and a means for establishing the ends of the legs opposite the collar to the inside of the side wall between the open end of said first wastebasket and the closed lower end of said first wastebasket so that said collar is positioned inside and in spaced relation with the side wall adjacent said upper rim, said collar and said side wall forming a gap therebetween.

9. The apparatus as set forth in claim 8 wherein the means for establishing includes means for removably securing the legs to the side wall.

10. The apparatus as set forth in claim 8 wherein the means for establishing includes:

an L-shaped bracket having a leg extending outward from the side wall into the wastebasket and a member attached to the end of the leg opposite the side wall and in spaced relation to the side wall, said member having a slot formed therein; and a lug formed on the legs opposite the collar, wherein the lug is receivable in the slot of the L-shaped bracket, and wherein said slot has a closed end to limit movement of the lug in the slot.

11. The apparatus as set forth in claim 8 wherein the collar has an outline of the same shape as an outline of an upper rim of the first wastebasket.

12. The apparatus as set forth in claim 11 wherein the collar and the closed lower end of the first wastebasket have an outline of substantially similar size.

13. The apparatus as set forth in claim 12 wherein the collar is invertible so that the top of the collar is positionable adjacent the closed lower end and the legs extend towards the open end of the first wastebasket.

14. The apparatus as set forth in claim 13 wherein a second wastebasket of similar construction to the first wastebasket is receivable in the open end of the first wastebasket when said collar is positioned at the closed lower end of the first wastebasket so that said collar with upwardly extending legs is sandwiched between the first wastebasket and the second wastebasket when the closed lower end of the second wastebasket is received through the open end of the first wastebasket.

15. The apparatus as set forth in claim 8 wherein the means for establishing establishes the legs to the inside of the side wall of the first wastebasket so that an upper edge of said collar is positioned even with the upper rim of said wastebasket.

16. A sleeve adapted for securing the open end of a collapsible open end bag to a wastebasket having a side wall extending between a closed end and a open end thereof, said sleeve comprising:

a tube having an upper edge and a lower edge and an aperture extending therebetween, said tube positionable inside said wastebasket so that the lower edge engages the side wall between the open end of the wastebasket and closed end of the wastebasket, the upper edge of the sleeve is located adjacent the open end of said wastebasket when the lower edge of the tube is positioned between the open end of the wastebasket and closed end of the wastebasket and the tube and the side wall of the wastebasket form a gap therebetween adjacent the open end of said wastebasket.

17. The sleeve as set forth in claim 15 wherein the tube tapers outwardly from the upper edge to the lower edge.

18. The sleeve as set forth in claim 15 wherein the tube has a plurality of apertures formed therein, said aperture forming an upper collar adjacent the upper edge of said tube and a lower collar adjacent the lower edge of the tube and one or more legs extending between the upper collar and the lower collar.

19. The sleeve as set forth in claim 17, wherein the tube diverges from the upper collar to the lower collar.

20. The sleeve as set forth in claim 15 wherein the tube includes a plurality of apertures formed therein, said aperture forming a collar adjacent the upper edge of the tube and a plurality of legs extending from the collar, the ends of said legs opposite said collar fixedly positionable between the open end of said wastebasket and the closed end of the wastebasket when said sleeve is positioned in said wastebasket.

* * * * *